US007437860B2

(12) United States Patent
Brandow et al.

(10) Patent No.: US 7,437,860 B2
(45) Date of Patent: Oct. 21, 2008

(54) STAMP APPLICATOR WITH AUTOMATIC SIZING FEATURE

(75) Inventors: Jason L. Brandow, Jenison, MI (US); Bruce D. DeBoer, Jenison, MI (US); Marc J. Wilson, Wyoming, MI (US); James S. Rabourn, Wyoming, MI (US)

(73) Assignee: R.E.D. Stamp, Inc., Grand Rapids, MI (US)

( * ) Notice: Subject to any disclaimer, the term of this patent is extended or adjusted under 35 U.S.C. 154(b) by 0 days.

(21) Appl. No.: 11/605,060

(22) Filed: Nov. 28, 2006

(65) Prior Publication Data

US 2007/0251189 A1 Nov. 1, 2007

Related U.S. Application Data

(60) Provisional application No. 60/796,496, filed on May 1, 2006.

(51) Int. Cl.
*B65B 61/00* (2006.01)
*B65C 9/40* (2006.01)

(52) U.S. Cl. ..... 53/135.1; 53/58; 53/504; 156/363; 156/DIG. 4

(58) Field of Classification Search ..... 53/56, 53/58, 504, 135.1; 156/64, 356, 357, 362, 156/363, DIG. 2, DIG. 4
See application file for complete search history.

(56) References Cited

U.S. PATENT DOCUMENTS 2,516,783 A * 7/1950 Matter ..... 156/DIG. 2
2,916,859 A * 12/1959 Klein ..... 156/DIG. 4
3,025,211 A * 3/1962 Winn ..... 156/DIG. 2
3,477,198 A 11/1969 Davis
3,513,616 A 5/1970 Davis
3,584,432 A 6/1971 Mayer, Jr.
3,765,145 A 10/1973 Davis
3,902,406 A 9/1975 Reichert
4,017,350 A 4/1977 Thomas
4,063,643 A 12/1977 Wickstead
4,084,501 A 4/1978 Kerwin et al.
4,101,362 A 7/1978 Baker et al.
4,184,305 A 1/1980 Baker et al.
4,263,766 A 4/1981 Baker et al.
4,265,355 A 5/1981 Davis
4,462,851 A 7/1984 Colgate, Jr.
4,533,586 A 8/1985 Roule et al.
4,585,504 A 4/1986 Marchetti
4,589,943 A 5/1986 Kimball et al.
4,648,933 A 3/1987 Graziano (Continued)

OTHER PUBLICATIONS

Exhibit A- Prior art measuring station/device sold at least as early as Apr. 1, 2005.

*Primary Examiner*—Louis K Huynh
(74) *Attorney, Agent, or Firm*—Price, Heneveld, Cooper, DeWitt & Litton, LLP

(57) ABSTRACT

A stamp applicator includes a sizing feature that measures the size of a carton of cigarettes entering the machine. The sizing feature may include sensors that determine both the height and width of a carton of cigarettes. The applicator includes a stamping head and other features that may be adjusted to accommodate cartons of different sizes. The stamp applicator may include sensors that determine if a carton of cigarettes is properly positioned prior to moving the cartons through the machine for further processing.

22 Claims, 5 Drawing Sheets

U.S. PATENT DOCUMENTS 4,655,871 A 4/1987 Mattei et al.
4,657,622 A 4/1987 Paules
4,664,740 A 5/1987 Wilkinson
4,762,587 A 8/1988 Deal
4,969,305 A 11/1990 York et al.
5,019,029 A 5/1991 Calvert
5,168,883 A 12/1992 Winn
5,232,539 A 8/1993 Carpenter et al.
5,255,495 A * 10/1993 Kovacs ..... 53/504
5,342,461 A 8/1994 Murphy
5,408,927 A 4/1995 Gallagher et al.
5,440,852 A 8/1995 Lam
5,582,663 A 12/1996 Matsunaga
5,657,855 A 8/1997 Ferguson
5,755,074 A 5/1998 Fetters
5,794,417 A 8/1998 Mohrman
5,954,913 A 9/1999 Wurz et al.
6,325,877 B1 12/2001 Murphy
6,413,315 B1 7/2002 Hendricks
6,561,246 B2 5/2003 Yang
6,672,356 B1 1/2004 Jenkins et al.
6,878,222 B1 4/2005 Os
7,089,711 B2 * 8/2006 Timmerman et al. ..... 53/504
7,131,249 B2 * 11/2006 Michelotti ..... 53/504
2003/0116285 A1 6/2003 Michalski et al.
2004/0045660 A1 3/2004 Chojnacki
2004/0045676 A1 3/2004 Chojnacki et al.
2004/0084130 A1 5/2004 Michalski et al.
2004/0094253 A1 5/2004 Jenkins et al.
2005/0050848 A1 * 3/2005 Harding ..... 53/58
2005/0210832 A1 9/2005 Tassin et al.

* cited by examiner

STAMP APPLICATOR WITH AUTOMATIC SIZING FEATURE

CROSS-REFERENCE TO RELATED APPLICATIONS

This application claims the benefit of U.S. Provisional Application No. 60/796,496, filed on May 1, 2006, entitled STAMP APPLICATOR WITH AUTOMATIC SIZING FEATURE, the entire contents of which are incorporated by reference.

BACKGROUND OF THE INVENTION

Various devices have been developed for stamping or otherwise applying tax information to cartons of cigarettes. Such stamps are normally specific to a given state and/or local region. The stamps are typically applied prior to shipment of the cigarettes to a retailer such as a gas station or the like. Also, a given retailer may order a variety of different brands and sizes of cigarettes for a particular shipment.

Accordingly, machines have been designed to stamp cartons of cigarettes having various different types of stamps and different types and sizes of cigarettes and cigarette cartons. One type of tax stamping machine requires manual height and/or width adjustment to setup the machine prior to stamping cartons of a particular size. Attempts have been made to provide a stamping machine that can automatically accommodate cigarette cartons of different sizes without manual height and/or width adjustment by the operator. However, known devices suffer from various drawbacks. For example, the rate at which the machine can stamp cigarette cartons of different sizes may be quite limited. Also, such machines may not be entirely reliable in use, causing the cartons to become damaged or otherwise jammed in the machine if the machine does not function properly when attempting to accommodate cartons of different sizes.

Accordingly, a tax stamping machine capable of quickly and reliably stamping cigarette cartons of various sizes without manual adjustment by an operator would be advantageous.

SUMMARY OF THE INVENTION

A tax applicator according to one aspect of the present invention includes at least one sensor that measures the height or width of a carton of cigarettes entering the stamping machine. First and second sensors may be utilized to measure both the height and width of the carton of cigarettes. The sensors may include a movable member having a tapered forward surface that contacts the carton of cigarettes as they enter the measuring station. The stamping machine includes one or more stamping heads and other components that may be adjusted to accommodate differently-sized cartons of cigarettes. The stamping machine may include sensors at the in-feed conveyor to determine if a carton of cigarettes is properly positioned prior to moving the carton of cigarettes through the machine.

BRIEF DESCRIPTION OF THE DRAWINGS

FIG. 4; FIG. 4.

DETAILED DESCRIPTION OF PREFERRED EMBODIMENT

Figure 1:
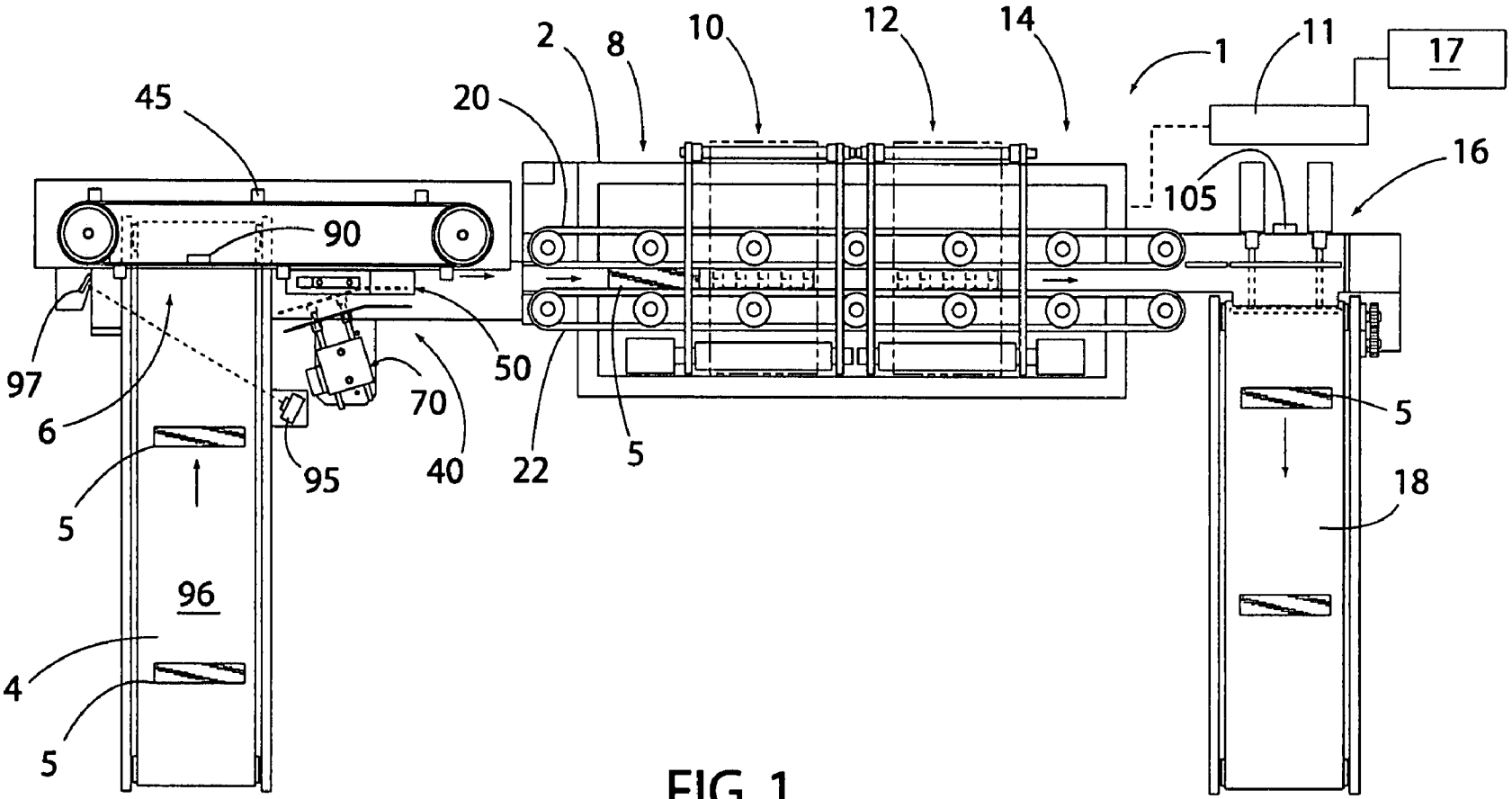
FIG. 1 is a partially schematic plan view of a cigarette stamp applicator with automatic sizing feature according to one aspect of the present application.
Figure 2:
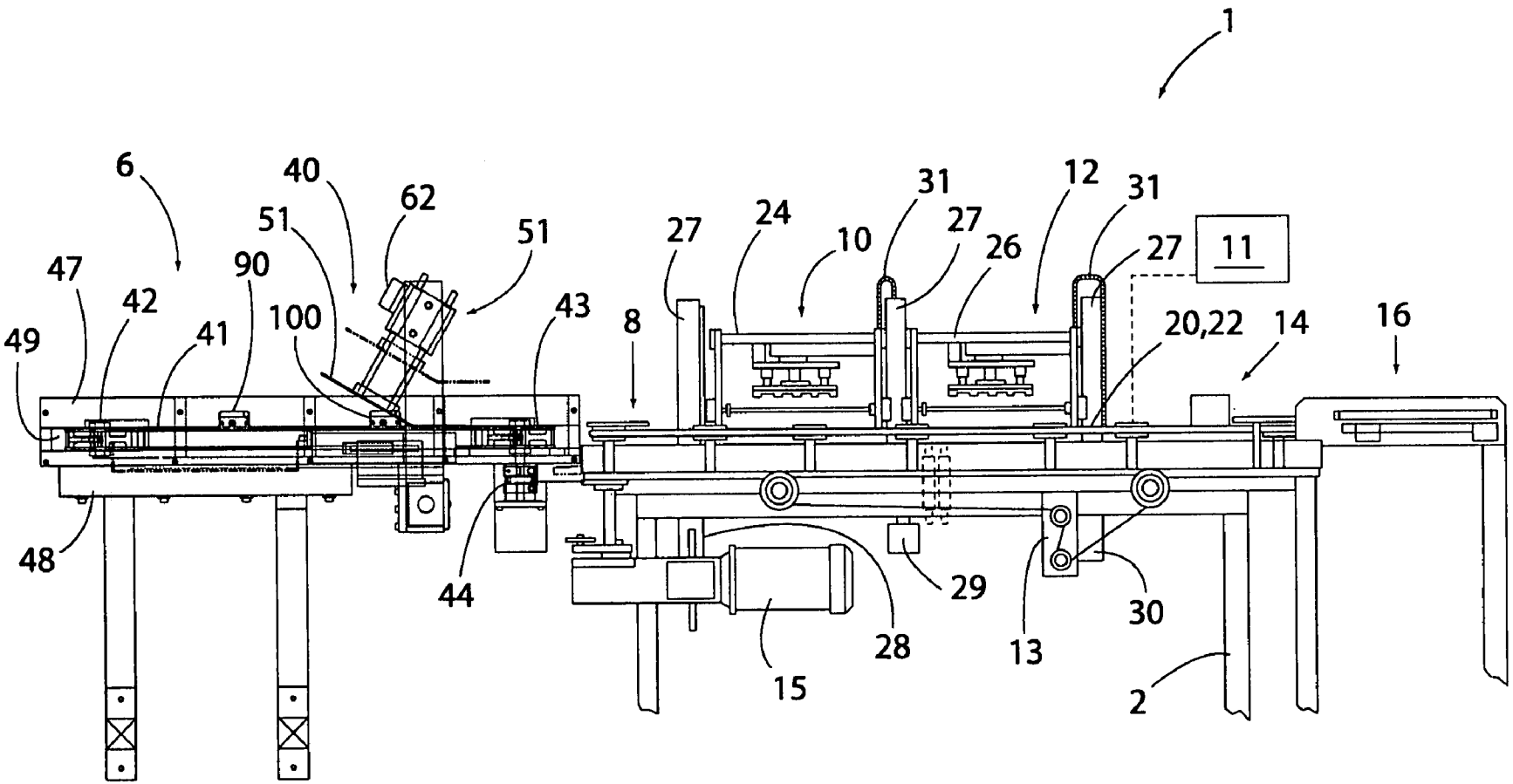
FIG. 2 is a side elevational view of the cigarette stamp applicator of FIG. 1.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A stamping apparatus 1 (FIGS. 1 and 2) includes an in-feed conveyor 4, a loading station 6, an opening station 8, a first stamping station 10, and a second stamping station 12. The stamping apparatus 1 further includes a closing station 14, an unloading station 16, and an out-feed conveyor 18. First and second side-by-side conveyors 20 and 22 move cartons 5 of cigarettes or the like through the opening station, first and second stamping stations 10, 12, respectively, and closing station 14 to the unloading station 16. A programmable controller is operably connected to the various components to provide for automatic height adjustment. The apparatus 1 includes a support structure such as a frame 2 for supporting the various components.

Opening station 8 is generally of a known type that may be vertically adjusted to accommodate cigarette cartons of various sizes. Opening station 8 may be substantially similar to the opening station illustrated in Os U.S. Pat. No. 6,878,222, the entire contents of which are incorporated by reference. Also, the first and second stamping stations 10 and 12 are also of a known design that can be vertically shifted to adjust for various sizes of cigarette cartons. In the illustrated example, stations 10 and 11 are substantially similar to the (single) stamping station illustrated in Os '222. However, unlike the arrangement of Os '222, stamping apparatus 1 may include both a first and a second stamping station to provide for stamping of two different tax stamps if required for a particular geographic area or for other reasons. The closing station 14 and conveyors 20 and 22 may be substantially similar to the closing station and conveyors disclosed in Os '222.

The opening station, stamping stations, and closing stations can not only be adjusted to accommodate cigarette cartons of different heights, but they can also be adjusted to accommodate cartons of different widths. Belts or conveyors 20 and 22 move the cartons of cigarettes 5 from the opening station 8 through the first and second stamping stations 10 and 12, and to the closing station 14 and unloading station 16. The height of stamping stations 10 and 12, as well as opening station 8 and closing station 14 can be adjusted by actuation of a motor 13 by controller 11 to thereby accommodate cartons 5 of cigarettes having different height dimensions. In the illustrated example, the stamping stations 10 and 12 include stamping head assemblies 24 and 26, respectively, that are mounted to vertical slides 27, and the head assemblies 24 and 26 can be vertically shifted via actuation of electric motor 29 which is operably coupled to the controller 11. Electrical power and/or control lines 31 provide for power and/or control of the powered components of stamp head assemblies 24 and 26. In the illustrated example, the lines 31 are supported by commercially available supports/guides having a plurality of individual links that form upwardly extending loops. The spacing between conveyors 20 and 22 can also be automatically adjusted by actuation of an electric actuator 28 by controller 11 to accommodate cigarette cartons 5 having different widths. Belts or conveyors 20 and 22 are driven by a motor 15 that is operably connected to controller 11. It will be understood that opening stations, stamping stations, and closing stations having powered height and/or width adjustment that can be controlled by a programmable controller are generally known, such that these features will not be described in detail herein.

Stamping apparatus 1 includes a measuring station 40 that automatically measures the size of cartons 5 after they pass through station 6. The measuring station 40 measures the height and width of the cartons 5 and sends the size information to the controller 11. The controller 11 is programmed to set the height of the opening station 8, stamping stations 10 and 11, and closing station 14 based upon the height information measured by the measuring station 40. Also, controller 11 automatically sets the spacing between the conveyors 20 and 22 based upon the width of cartons 5 measured by measuring station 40.

Figure 3:
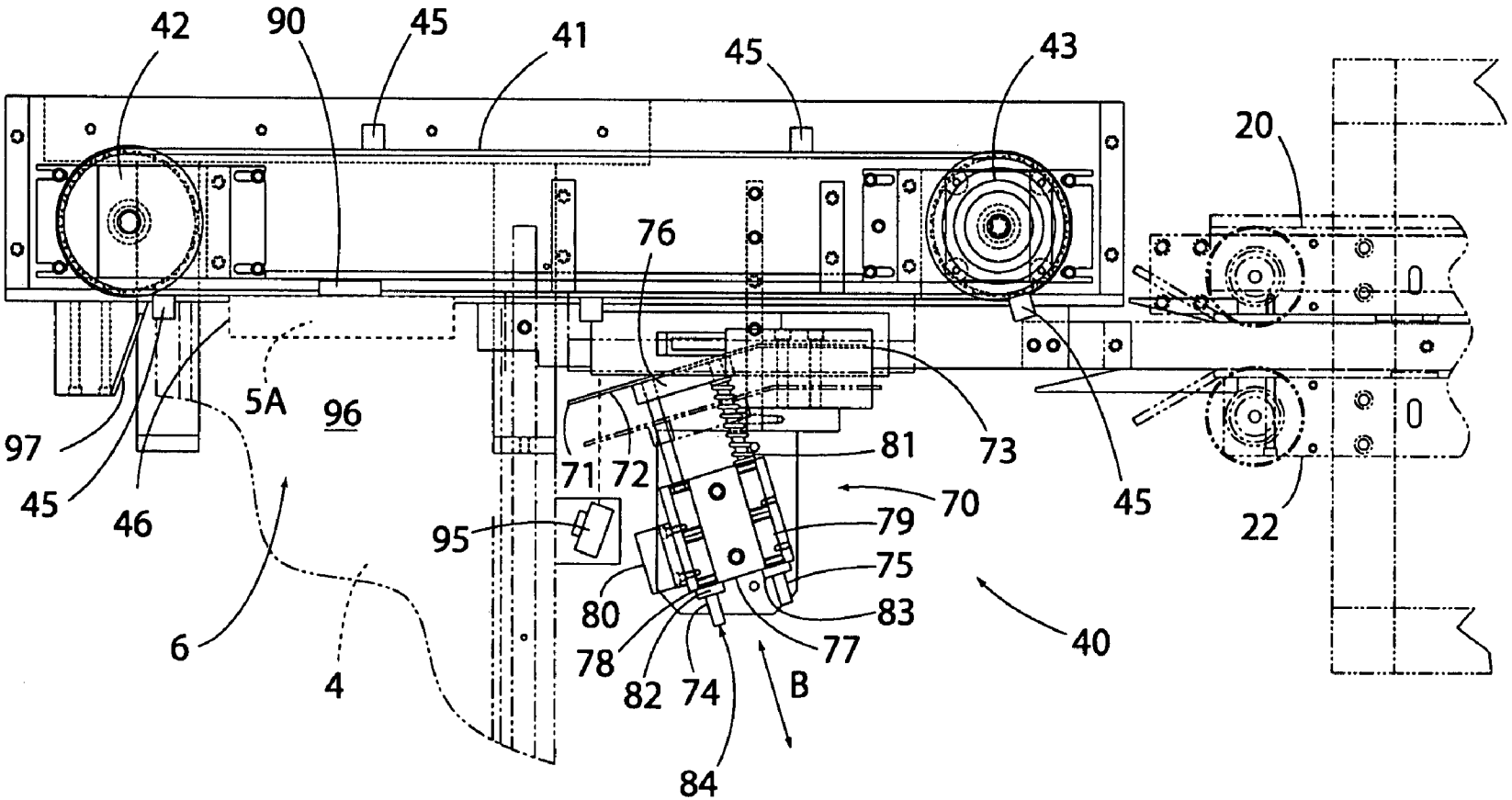
FIG. 3 is an enlarged plan view of a portion of the cigarette stamp applicator of FIG. 1, showing a loading station and a measuring station.
Figures 4, 5:
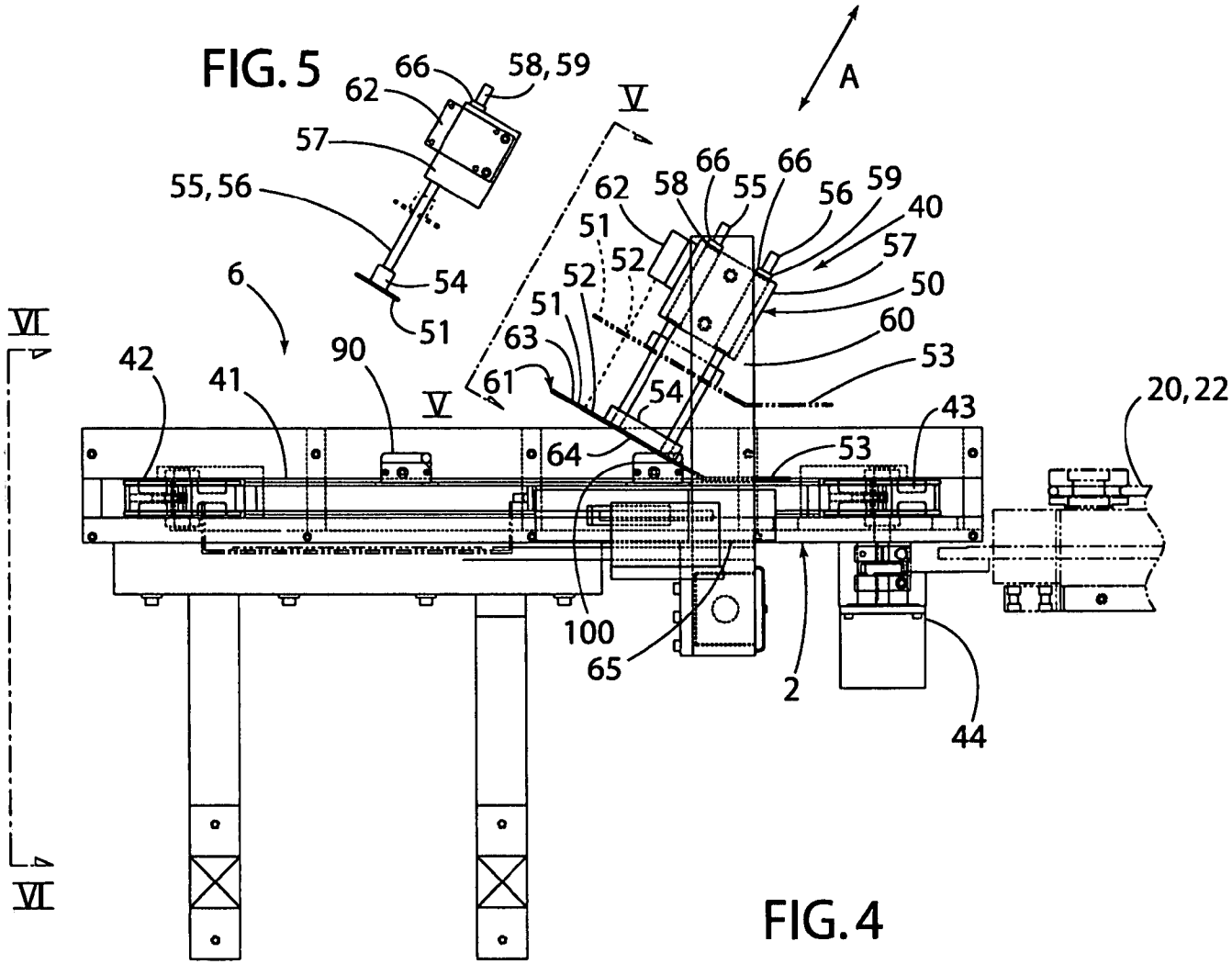
FIG. 4 is an elevational view of a portion of the cigarette stamp applicator of FIG. 2, showing a loading station and a measuring station.
FIG. 5 is an enlarged view of a portion of the sizing device taken along the line V-V.
Figure 6:
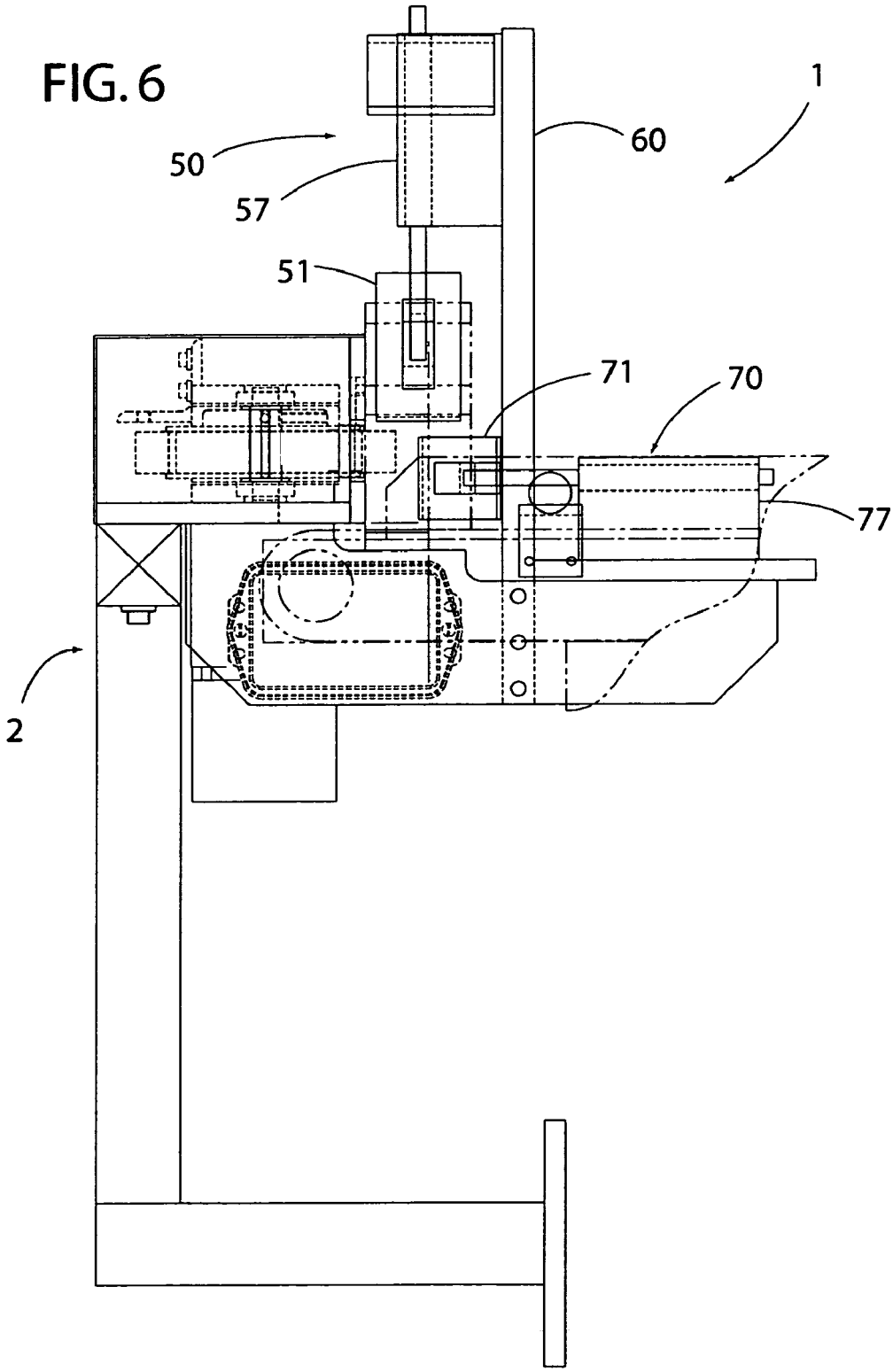
FIG. 6 is a partially fragmentary view of the cigarette stamp applicator taken along the line VI-VI.

With further reference to FIGS. 3 and 4, loading station 6 includes a cogged belt 41 that is mounted to cogged pulleys 42 and 43. An upper plate 47 and lower plate 48 extend horizontally, and form a gap 49 therebetween. The portion of belt 41 extending along loading station 6 and measuring station 40 is disposed in gap 49, and the plates 47 and 48 provide support for a carton of cigarettes 5 when they are moved into loading station 6 by in-feed conveyor 4. Plates 47 and 48 also guide the cartons 5 as they are shifted from loading station 6 into measuring station 40, and further from measuring station 40 into opening station 8. It will be understood that upper surface 96 of conveyor 4 provides sufficient friction to move the cartons of cigarettes 5 placed on conveyor 4, yet has a low enough coefficient of friction to permit the conveyor 4 to continue moving after the cartons 5 have come into contact with plates 47 and 48 in loading station 6 without damaging the lower surface of the cartons of cigarettes 5. Pulley 43 is driven by an electrical motor 44 that is operably connected to controller 11. Belt 41 includes a plurality of blocks 45 that protrude outwardly from belt 41. In use, blocks 45 engage trailing side or surface 46 of a carton 5A to shift the carton 5A from loading station 6 into measuring station 40. It will be understood that controller 11 can control electrical motor 44 so it rotates a precise angular distance in a start-and-stop manner to thereby shift a carton 5A from loading station 6 into measuring station 40, and from measuring station 40 into conveyors 20 and 22 to thereby move a carton 5 to opening station 8.

A height sensor 50 (FIG. 4) of measuring station 40 includes a relatively thin plate member 51 having an angled forward portion 52 and a flat trailing portion 53. A block 54 is welded or otherwise secured to plate 51, and first and second rods 55 and 56 are mounted to the block 54 to form a moving assembly 61. A stationary block 57 is mounted to support member 60, and includes first and second linear bearings 58 and 59 that movably engage the rods 55 and 56 to thereby provide for linear movement of plate member 51 in a reciprocating manner along the axis of rods 55 and 56 as indicated by the arrow "A". Gravitational forces bias moving assembly 61 to the lowermost position. Adjustable stops 66 may be secured to rods 55 and 56 to provide for adjustment of the lowermost position of plate member 51. Stops 66 may comprise ring-like members with set screws, wherein the rings contact stationary block 57 to limit the downward travel of sliding assembly 61.

A proximity sensor 62 is mounted to stationary block 57. Proximity sensor 62 sends a light signal that hits upper surface 63 of angled portion 52 of plate member 51. The light is reflected back towards the proximity sensor 62, and the proximity sensor 62 thereby determines the position of plate member 51 relative to proximity sensor 62. Proximity sensor 62 is operably connected to controller 11, and controller 11 thereby determines the height of a carton 5 in measuring station 40.

In use, cigarette cartons 5 are pushed from loading station 6 into measuring station 40 by belt 41. As the cartons 5 move from loading station 6 to measuring station 40, the upper leading corner of the cartons 5 contact lower surface 64 of forward portion 52 of plate 51, thereby shifting the plate member 51 upwardly in the direction of the arrow A. When a carton of cigarettes 5 contacts lower surface 64 of plate member 51, the carton will slide along surface 64, generating a force having components in the horizontal direction and in the vertical direction. Rods 55 and 56 are mounted at an angle, and preferably extend in about the same direction as the force acting on surface 64 of plate 51 due to sliding contact with a carton of cigarettes. In this way, the angled forward portion 52 of plate 51 accommodates a large number of different cigarette carton sizes, and the angled positioning of rods 55 and 56 ensures that the sliding assembly 61 does not bind as could otherwise occur if rods 55 and 56 were vertically oriented. Eventually, the upper surface of cartons 5 contacts lower surface 65 of trailing portion 53 of plate 51, and the movement of plate member 51 therefore stops, and the position of the plate member 51 remains the same so long as a carton of cigarettes 5 remains in measuring station 40. Proximity sensor 62 measures the distance between proximity sensor 62 and forward portion 52 of plate 51, and thereby determines the height of a carton of cigarettes in the measuring station 40. Belt 41 is then actuated to shift the carton of cigarettes from measuring station 40 into engagement with conveyor belts 20 and 22 for opening, stamping, and closing of the carton of cigarettes.

In the illustrated example, the position and length of flat trailing portion 53 of plate 51 is chosen such that the trailing upper corner of a carton of cigarettes does not move out of contact with lower surface 65 until the leading upper corner of the next carton of cigarettes 5 is positioned immediately below at least a portion of lower surface 65 of plate member 51. In this way, sliding assembly 61 remains at substantially the same height if a plurality of cigarette cartons having the same size are fed through the stamping apparatus 1, and the amount of movement of sliding assembly 61 is greatly reduced. This arrangement facilitates high speed operation of the stamping apparatus 1, and also alleviates wear and potential inconsistency in measurement that might otherwise occur. Also, it will be understood that the difference in height between various cartons of cigarettes is often relatively small, such that the amount of movement of sliding assembly 61 is relatively small, even if cartons of cigarettes having different height dimensions are fed through stamping apparatus 1.

Significantly, the vertical position of each carton of cigarettes 5 does not change as it moves through the stamping apparatus 1 from the loading station 6 to the unloading station 16. Rather, the height of the opening shoe at opening station 8, stamp head assemblies 24 and 26, and closing member at closing station 14 are vertically shifted. This arrangement substantially increases the rate at which cartons can be fed through stamping apparatus 1 compared to prior machines that vertically shift the carton to adjust for height.

With reference to FIG. 3, a width sensor 70 of measuring station 40 includes a plate member 71 having angled forward portion 72 and trailing portion 73. First and second rods 74 and 75 are fixed to plate 71 via a block 76, and the rods 74 and 75 are slidably mounted to a stationary block 77 via linear bearings 78 and 79 or the like. A proximity sensor 80 is mounted to the stationary block 77, and measures the distance between proximity sensor 80 and the angled portion 72 of plate 71 to thereby measure the width of a carton of cigarettes or the like positioned in the measuring station 40. Proximity sensor 80 is operably connected to the programmable controller 11, and thereby transmits a signal from which the width of a cigarette carton in measuring station 42 can be determined by the controller 11. A coil spring 81 is positioned on rod 75 to thereby bias the plate 71 to the extended position. Adjustable stops 82 and 83 are mounted to rods 74 and 75 to limit the travel of plate 71 towards the extended position. The trailing portion 73 of plate 71 is sized and positioned such that a side surface of a carton of cigarettes is not disengaged from trailing portion 73 of plate 71 until the next carton 5 has contacted the trailing portion 73 to thereby minimize the back and forth movement of sliding assembly 84 in the direction of arrow "B". Controller 11 automatically adjusts the spacing between conveyors 20 and 22 to accommodate the cigarette carton as required depending upon the width of the cigarette carton. The angled position of rods 74 and 75 and angled portion 72 of plate 71 ensures that sliding assembly 84 of width sensor 70 does not bind during operation.

Loading station 6 includes a first sensor 90 (FIG. 4) that is configured to determine if a carton of cigarettes 5 has been pushed against belt 41 by in-feed conveyor 4. The sensor 90 is positioned at a height whereby sensor 90 only senses the presence of a carton of cigarettes if the carton is in the upright position and substantially flat against belt 41 between blocks 45. In the illustrated example, sensor 90 comprises a capacitive proximity sensor that senses if a carton of cigarettes is within a few mm or less, but does not sense the presence of, for example, an empty carton of cigarettes, or a carton of cigarettes that is tipped on its side. If a carton of cigarettes 5 tips onto its side, sensor 90 will not detect the presence of the carton 5 even if the carton 5 is pushed against belt 41 between blocks 45. It will be appreciated that a carton of cigarettes 5 is substantially higher than it is wide, such that sensor 90 can be positioned to detect virtually any commercially available carton of cigarettes when the carton is in the upright position, yet not generate a signal indicating a carton of cigarettes is present when a carton is lying on its side.

A second "photo eye" sensor 95 (FIG. 3) is mounted to frame 2 adjacent in-feed conveyor 4. Sensor 95 generates a light signal that passes over conveyor 4 directly adjacent the upper surface 96 of conveyor 4. Light from sensor 95 is reflected back across conveyor 4 by a reflector 97 that is mounted at an angle directly adjacent belt 41. Reflector 97 is a commercially available unit adapted to operate in conjunction with sensor 95. If a carton of cigarettes 5 on in-feed conveyor 4 is positioned between sensor 95 and reflector 97, sensor 95 will thereby determine that a carton of cigarettes 5 is present. Sensor 95 and reflector 97 are configured to detect the presence of a carton of cigarettes 5 when a carton is in either an upright position, or when a carton is tipped over on its side.

A third sensor 100 is positioned in measuring station 40 to detect the presence of a carton of cigarettes. In the illustrated example, sensor 100 is substantially identical to sensor 90, and generates a signal to controller 11 if a carton of cigarettes is present in measuring station 40.

The sensors 90, 95 and 100 together cooperate to ensure proper operation of the loading station 6 and measuring station 40. Controller 11 is programmed to actuate electrical motor 44 and thereby shift belt 41 to move a carton of cigarettes 5 from loading station 6 to measuring station 40 only if certain conditions determined by sensors 90, 95 and 100 are present. In general, controller 11 is programmed to advance belt 41 to shift a carton of cigarettes from measuring station 40 to opening station 8 if the stations 8, 10, 12 and 14 are set at the proper height, and if an out-feed sensor 105 (FIG. 1) indicates that the unloading station 16 is clear. For purposes of discussion, this signal will be referred to herein as a "FEED" signal. It will be understood that the conditions under which controller 11 will generate a FEED signal will vary depending upon the specific configuration and requirements of a particular stamping machine. Sensors 90, 95 and 100 "block" or nullify a FEED signal from controller 11 if sensor 95 indicates the presence of a carton of cigarettes, at the same time sensor 90 does not detect the presence of a carton of cigarettes and sensor 100 also detects the presence of a carton of cigarettes. This combination of sensor signals occurs when a carton of cigarettes is tipped on its side, thereby generating a signal from second sensor 95 detecting the presence of a carton of cigarettes 5, at the same time sensor 90 does not detect a carton of cigarettes. Restated, if sensor 95 detects a carton of cigarettes at the same time sensor 90 does not detect a carton of cigarettes, it can be concluded that a carton of cigarettes is present, but tipped on its side. If this condition occurs at the same time sensor 100 detects the presence of a carton of cigarettes 5 in measuring station 40, controller 11 is programmed not to generate a FEED signal advancing belt 41 because the carton of cigarettes tipped on its side would jam measuring station 40 and/or the other stations in the machine. Controller 11 may be operably connected to a display/user control panel 17, and controller 11 may generate a signal that is displayed to alert an operator if a carton of cigarettes has tipped over at loading station 6.

A FEED signal from controller 11 is allowed if one of three conditions of sensors 90, 95 and 100 are detected. First, if sensor 90 detects the presence of a carton of cigarettes at the same time sensor 100 determines that no carton is in measuring station 40, controller 11 will generate a FEED signal (provided the other required conditions for a FEED signal are present). This combination of sensor signals indicates that a carton of cigarettes is in the upright position in loading station 6, but there is no carton of cigarettes in measuring station 40.

A second set of conditions under which a FEED signal from controller 11 will be allowed is if sensors 95 and 100 both detect the presence of a carton of cigarettes. Under these conditions, the carton of cigarettes 5 in measuring station 40 can be feed into opening station 8, and the carton of cigarettes 5 in loading station 6 can be fed into measuring station 40.

A third set of conditions under which a FEED signal from controller 11 is permitted is if sensors 90 and 95 both do not detect the presence of a carton of cigarettes, and sensor 100 does detect the presence of a carton of cigarettes.

The sensors 90, 95 and 100 thereby cooperate to ensure that cartons of cigarettes 5 being fed into stamping apparatus 1 along in-feed conveyor 4 are not advanced into measuring station 40 if the cartons of cigarettes 5 are lying on their side or otherwise misaligned or jammed.

The automatic height adjusting station 40 of stamping apparatus 1 permits a very high rate of feed of cigarette cartons 5 in a very reliable manner. Also, the sensors at the loading station 6 and measuring station 40 ensure that the stamping apparatus 1 is not jammed due to cartons of cigarettes that have tipped over, or are otherwise misaligned.

In the foregoing description, it will be readily appreciated by those skilled in the art that modifications may be made to the invention without departing from the concepts disclosed herein.

The invention claimed is:

1. A stamping apparatus for applying tax stamps to packages of cigarettes, the stamping apparatus comprising:

a support structure;

a conveyor assembly mounted to the support structure, the conveyor assembly configured to move cartons of cigarettes along a path in a downstream direction from an upstream area to a downstream area;

a measuring station proximate the upstream area, the measuring station including a base connected to the support structure and a carton-engaging structure that is movably mounted to the base such that the carton-engaging structure engages cartons of cigarettes in the measuring station and moves in a direction having components of movement that are transverse to the path and parallel to the path, the measuring station further including a sensor that measures a position of the carton-engaging structure to thereby measure a height of cartons of cigarettes at the measuring station;

an opening station proximate the measuring station, the opening station including an opening member that at least partially opens cartons of cigarettes being processed in the stamping apparatus to provide access to individual packages of cigarettes in the cartons, wherein the opening member is transversely movable, under power, relative to the conveyor assembly to accommodate cartons of different sizes;

a stamping station downstream from the opening station, the stamping station including a stamping head that applies tax stamps to packages of cigarettes, the stamping head being powered for transverse movement relative to the conveyor to accommodate cartons of different sizes; and a controller receiving a signal from the height measuring device indicative of the height of a carton of cigarettes, the controller causing the opening member and the stamping head to move relative to the conveyor assembly to accommodate cartons of cigarettes having different height dimensions.

2. The stamping apparatus of claim 1, wherein:

the measuring station includes a width measuring device that measures a width of cartons of cigarettes at the measuring station; and the conveyor assembly includes horizontally spaced-apart conveyor members defining a width therebetween, wherein the controller moves at least one of the conveyor members horizontally relative to the other of the conveyor members to thereby change the width to accommodate cartons of cigarettes having different width dimensions based, at least in part, upon a width measured by the width measuring device.

3. The stamping apparatus of claim 2, wherein:

the conveyor assembly includes a motor;

at least one of the conveyor members comprises an elongated flexible member forming a loop, wherein the elongated flexible member is driven by the motor to move cartons of cigarettes along the path.

4. The stamping apparatus of claim 2, wherein:

the horizontally spaced-apart conveyor members comprise elongated flexible members forming loops with generally linear portions of the loops extending parallel to the path on opposite sides thereof, elongated flexible members being powered for longitudinal movement of the linear portions to engage opposite sides of cartons of cigarettes.

5. The stamping apparatus of claim 1, wherein:

the conveyor assembly includes upwardly-facing support surface portions that support cartons of cigarettes as the cartons move along the path, wherein the support surface portions support cartons of cigarettes in at least the measuring station, the opening station, and the stamping station as the cartons move along the path, the support surface portions supporting the cartons at substantially the same height in the measuring station, the opening station, and the stamping station.

6. The stamping apparatus of claim 1, wherein:

the path is substantially linear and horizontal.

7. The stamping apparatus of claim 1, wherein:

the path comprises a primary path, the conveyor assembly comprises a primary conveyor assembly, and including:

an in-feed conveyor extending transverse relative to the primary path and including a downstream end at a loading station adjacent the measuring station;

a loading conveyor configured to move cartons of cigarettes from the in-feed conveyor to the primary conveyor assembly;

a sensor configured to determine if a carton of cigarettes is properly engaging the loading conveyor; and wherein:

the controller is configured to actuate the loading conveyor based, at least in part, on whether or not a carton of cigarettes is properly engaging the loading conveyor.

8. The stamping apparatus of claim 7, wherein:

the sensor only detects the presence of a carton of cigarettes if the carton of cigarettes is in an upright position on the in-feed conveyor.

9. A stamping apparatus for applying tax stamps to packages of cigarettes, the stamping apparatus comprising:

a support structure;

a conveyor assembly mounted to the support structure the conveyor assembly configured to move cartons of cigarettes along a path in a downstream direction from an upstream area to a downstream area;

a measuring station proximate the upstream area, the measuring station including at least a height measuring device that measures a height of cartons of cigarettes at the measuring station;

an opening station proximate the measuring station, the opening station including an opening member that at least partially opens cartons of cigarettes being processed in the stamping apparatus to provide access to individual packages of cigarettes in the cartons, wherein the opening member is transversely movable, under power, relative to the conveyor assembly to accommodate cartons of different sizes;

a stamping station downstream from the opening station, the stamping station including a stamping head that applies tax stamps to packages of cigarettes, the stamping head being powered for transverse movement relative to the conveyor to accommodate cartons of different sizes;

a controller receiving a signal from the height measuring device indicative of the height of a carton of cigarettes, the controller causing the opening member and the stamping head to move relative to the conveyor assembly to accommodate cartons of cigarettes having different height dimensions; and wherein the height measuring device includes a base connected to the support structure, and a carton-engaging member movably mounted to the base by a linear slide defining a line of movement of the carton-engaging member, the line of movement forming an acute angle with a portion of the path extending through the measuring station such that a component of movement of the carton-engaging member is parallel to movement of a carton of cigarettes through the measuring station.

10. The stamping apparatus of claim 9, wherein:

the carton-engaging member includes a measuring surface that contacts an outer surface of a carton of cigarettes in the measuring station and defines a maximum displacement of the carton-engaging member corresponding to a maximum transverse distance moved by the carton-engaging member relative to the path in the measuring station, the carton-engaging member further including an angled leading surface having a downstream portion adjacent the measuring surface and an upstream portion that is upstream relative to the downstream portion, and wherein the upstream portion is spaced further from the path than the downstream portion.

11. The stamping apparatus of claim 10, wherein:

the height measuring device includes a sensor configured to determine a position of the carton-engaging member relative to the base and communicate with the controller so the height of a carton in the measuring station can be determined and used by the controller to adjust a position of at least one of the opening member and the stamping head.

12. The stamping apparatus of claim 11, wherein:

the angled leading surface and the measuring surface are both substantially planar.

13. The stamping apparatus of claim 11, wherein:

the carton-engaging member moves as a carton contacts the upstream portion, and wherein the movement includes a vertical component; and the carton-engaging member is biased in a downward direction and an upstream direction due to gravity.

14. The stamping apparatus of claim 9, wherein:

the measuring station includes a width-measuring device having a second carton-engaging member movably mounted on a generally horizontal linear slide such that the second carton-engaging member shifts in a horizontal direction and a downstream direction as a carton of cigarettes contacts the second carton-engaging member, the width-measuring device including a resilient member biasing the second carton-engaging member into contact with cartons of cigarettes passing through the measuring station.

15. A stamping apparatus for applying tax stamps to packages of cigarettes, the stamping apparatus comprising:

a support structure;

a powered conveyor mounted to the support structure for moving cartons of cigarettes downstream through the stamping apparatus along a path from a loading area to an exit area;

an opening station including a height-adjustable opening member;

a stamping station downstream of the opening station, the stamping station having a height-adjustable stamping head configured to apply tax stamps to packages of cigarettes;

a measuring station upstream of the opening station, the measuring station including a carton-engaging member movably mounted to the support structure and moving when a carton of cigarettes is moved by the conveyor into the measuring station to thereby bring the carton of cigarettes into contact with the carton-engaging member, the carton-engaging member defining components of movement that are transverse to the path and parallel to the path when the carton-engaging member is moved due to contact with a carton of cigarettes, the measuring station further including a sensor configured to sense at least one of a position and the movement of the carton-engaging member; and a controller that controls a height at least one of the opening member and the stamping head based, at least in part, on a signal from the sensor.

16. The stamping apparatus of claim 15, wherein:

the carton-engaging member is mounted to the support structure by a linear slide.

17. The stamping apparatus of claim 15, wherein:

the sensor comprises a proximity sensor that utilizes reflected light to sense a position of the carton-engaging member.

18. The stamping apparatus of claim 15, wherein:

the carton-engaging member includes a tapered forward surface and a measuring surface that is generally parallel to the path at the measuring station.

19. The stamping apparatus of claim 18, wherein:

the tapered forward surface is generally planar and defines an upstream portion and a downstream portion, wherein the downstream portion is closer to the path than is the upstream portion.

20. A stamping apparatus for applying tax stamps to packages of cigarettes, the stamping apparatus comprising:

a support structure;

an opening station including a height adjustable opening member operably connected to the support structure to at least partially open a carton of cigarettes for processing in the stamping apparatus;

a stamping station having a height-adjustable stamping head operably connected to the support structure whereby the stamping head applies tax stamps to packages of cigarettes;

a measuring station including a sensor configured to determine at least one of the height and the width of a carton of cigarettes being processed by the stamping apparatus;

a primary conveyor configured to move cartons of cigarettes from an upstream area proximate the measuring station through the opening station and the stamping station;

a loading conveyor adjacent the upstream area;

an in-feed conveyor extending transverse to the loading conveyor, the in-feed conveyor having a moving upper surface that supports cartons of cigarettes and moves the cartons into engagement with the loading conveyor;

a first sensor that senses the presence of a carton of cigarettes on the in-feed conveyor when the carton is in engagement with the loading conveyor, but only if the cartons are in an upright position;

a second sensor configured to determine if a carton of cigarettes is on the in-feed conveyor adjacent the loading conveyor both when the carton is in an upright position and when the carton is tipped over on its side;

a third sensor that determines if a carton of cigarettes is in the measuring station;

a controller configured to control at least one of a height of the opening member and a height of the stamping head based, at least in part, on information received from the measuring station to accommodate different sizes of cartons; and wherein the controller does not actuate the loading conveyor and move cartons of cigarettes from the measuring station to the opening station if the second sensor indicates a carton of cigarettes is present at the same time the first sensor does not detect a carton of cigarettes and the third sensor detects a carton of cigarettes.

21. The stamping apparatus of claim 20, wherein:

the controller controls a height of the opening member and a height of the stamping head without raising or lowering the primary conveyor relative to the support structure.

22. A stamping apparatus for applying tax stamps to packages of cigarettes, the stamping apparatus comprising:

a support structure;

a primary conveyor assembly mounted to the support structure, the primary conveyor assembly configured to move cartons of cigarettes along a primary path in a downstream direction from an upstream area to a downstream area;

a measuring station proximate the upstream area, the measuring station including at least a height measuring device that measures a height of cartons of cigarettes at the measuring station;

an opening station proximate the measuring station, the opening station including an opening member that at least partially opens cartons of cigarettes being processed in the stamping apparatus to provide access to individual packages of cigarettes in the cartons, wherein the opening member is transversely movable, under power, relative to the conveyor assembly to accommodate cartons of different sizes;

a stamping station downstream from the opening station, the stamping station including a stamping head that applies tax stamps to packages of cigarettes, the stamping head being powered for transverse movement relative to the conveyor to accommodate cartons of different sizes;

an in-feed conveyor extending transverse relative to the primary path and including a downstream end at a loading station adjacent the measuring station;

a loading conveyor configured to move cartons of cigarettes from the in-feed conveyor to the primary conveyor assembly;

a first sensor configured to determine if a carton of cigarettes is properly engaging the loading conveyor wherein the first sensor only detects the presence of a carton of cigarettes if the carton of cigarettes is in an upright position on the in-feed conveyor; and wherein:

a second sensor configured to determine if a carton of cigarettes is on the in-feed conveyor adjacent the loading conveyor, when the carton is in an upright position, and when the carton is in a tipped-over position wherein the carton of cigarettes is lying on its side on the in-feed conveyor;

a third sensor configured to determine if a carton of cigarettes is in the measuring station; a controller receiving a signal from the height measuring device indicative of the height of a carton of cigarettes, the controller causing the opening member and the stamping head to move relative to the conveyor assembly to accommodate cartons of cigarettes having different height dimensions, wherein the controller is configured to actuate the loading conveyor based, at least in part, on whether or not a carton of cigarettes is properly engaging the loading conveyor, and wherein;

the controller does not shift a carton of cigarettes from the measuring station to the opening station if the second sensor indicates a carton of cigarettes is present at the same time the first sensor does not detect a carton of cigarettes and the third sensor detects a carton of cigarettes.

* * * * *